United States Patent [19]

Taylor et al.

[11] Patent Number: 5,019,220

[45] Date of Patent: May 28, 1991

[54] PROCESS FOR MAKING AN ENHANCED THERMAL AND IGNITION STABILITY AZIDE GAS GENERANT

[75] Inventors: Robert D. Taylor, Hynum; Gary L. Smith; Ritchie Olsen, both of Ogden, all of Utah

[73] Assignee: Morton International, Inc., Chicago, Ill.

[21] Appl. No.: 563,772

[22] Filed: Aug. 6, 1990

[51] Int. Cl.[5] ..... C06B 21/00

[52] U.S. Cl. ..... 264/3.4; 149/35; 149/109.6

[58] Field of Search ..... 264/3.4; 149/35, 109.6

[56] References Cited

U.S. PATENT DOCUMENTS

| | | | |
|---|---|---|---|
| 3,741,585 | 6/1973 | Hendrickson et al. | 149/35 |
| 3,775,199 | 11/1973 | Boyars et al. | 149/35 |
| 3,879,504 | 4/1975 | Sherman et al. | 264/3.4 |
| 3,883,373 | 5/1975 | Sidebottom | 149/35 |
| 3,895,098 | 7/1975 | Pietz | 149/35 |
| 3,920,575 | 11/1975 | Shiki et al. | 149/35 |
| 3,931,041 | 1/1976 | Breazeale | 149/35 |
| 3,996,079 | 12/1976 | DiValentin | 149/35 |
| 4,062,708 | 12/1977 | Goetz | 149/35 |
| 4,092,190 | 5/1978 | Flanagan | 149/35 |
| 4,203,787 | 5/1980 | Kirchoff et al. | 149/35 |
| 4,265,406 | 5/1981 | Palgrave et al. | 149/109.6 |
| 4,369,079 | 1/1983 | Shaw | 149/2 |
| 4,376,002 | 3/1983 | Utracki | 149/35 |
| 4,533,416 | 8/1985 | Poole | 149/35 |
| 4,547,235 | 10/1985 | Schneiter | 149/35 |
| 4,604,151 | 8/1986 | Knowlton et al. | 149/35 |
| 4,734,141 | 3/1988 | Cartwright et al. | 149/35 |
| 4,758,287 | 7/1988 | Pietz | 149/35 |
| 4,836,255 | 6/1989 | Schneiter et al. | 149/35 |

*Primary Examiner*—Stephen J. Lechert, Jr.

*Attorney, Agent, or Firm*—Gerald K. White

[57] ABSTRACT

Multiple processes and apparatuses for improving the prior system of making gas generant pellets or tablets made of sodium azide, molybdenum disulfide and sulfur wherein powdered ingredients thereof are slurried in water, subjected to wet grinding, spray dried to a powdered material which is molded into pellets or tablets which find use in vehicle crash bags or inflators.

The first improvement to the old process and apparatus involves adjusting the basicity of the water to a pH of greater than 8.0 up to about 12.5 via the addition of sodium hydroxide, followed by the addition of sulfur and molybdenum disulfide and finally the sodium azide whereby azide addition is made to a basic mixture of the other ingredients thereby keeping hydrazoic acid concentration levels below about 3×10EXP(−3) moles per liter.

The second improvement to the old process and apparatus involves (1) softening the water before its use in slurrying the powdered ingredients to remove undesirable Ca and Mg ions and/or (2) adding sodium sulfide and/or tri-sodium phosphate to the slurry to precipitate any remaining undesirable Ca, Mg, Pb, Fe, Mn and Cu ions as non-hazardous compounds. Each of these metal ions is reduced to no more about 25 ppm or less.

Also these two improvements are joined together to form a system wherein even better safety results occur.

The improvements not only extend to the final product produced, but to the intermediates at the slurry stage as well as at the spray dried state, which products differ due to significant elimination or minimization of hydrazoic acid and other contaminant metal ion species above mentioned.

43 Claims, 2 Drawing Sheets

PROCESS FOR MAKING AN ENHANCED THERMAL AND IGNITION STABILITY AZIDE GAS GENERANT

BACKGROUND OF THE INVENTION

1. Field of the Invention

The invention relates generally to gas generating pellets or tablets capable of generating nitrogen gas at relatively low temperatures on the order of 200° to 1000° F. upon ignition to provide inflation for air bag passive restraint systems. More particularly this invention relates to an improved wet process and apparatus for processing the various make-up ingredients and fabricating pellets or tablets therefrom, along with the resulting improved products.

Though the propellant of this invention is especially designed and suited for creating nitrogen for inflating passive restraint vehicle crash bags, it would function equally in other less severe inflation applications, such as aircraft slides, and inflatable boats, and, more generally, find utility for any use where a low temperature, non-toxic gas is needed, such as for a variety of pressurization and purging applications, as in fuel and oxidizer tanks in rocket motors, for various portable and military equipment and operations where a storable source of nitrogen is desirable, for many laser applications and in outer space stations and outer space vehicle atmospheres where a source of nitrogen is needed, for example, to dilute oxygen.

2. Description of the Prior Art

The use of protective gas-inflated bags to cushion vehicle occupants in crash situations is now widely known and well documented. In early systems of this type, a quantity of compressed, stored gas was employed to inflate a crash bag which, when inflated, was positioned between the occupant and the windshield, steering wheel and dashboard of the vehicle. The compressed gas was released by the action of actuators or sensors which sense a rapid change in velocity of the vehicle during a rapid impact, as would normally occur during an accident.

Because of the bulk and weight of the compressed gas apparatus, its generally slow reaction time and attendant maintenance difficulties, stored gas systems have largely been superseded by systems utilizing a gas generated by chemical gas-generating compositions. These systems involve the use of an ignitable propellant for inflating the air cushion, wherein the inflating gas is generated by the exothermic reaction of the reactants which form the propellant.

The bags used in a restraint system of this type must be substantially inflated within a very limited time span, generally on the order of tens of milliseconds, to accomplish their purpose. In addition, the gas thus produced should meet several rather stringent requirements. As for example, the temperature of the gas as generated should be low enough so as not to burn the bag, undermine its mechanical strength, or burn, or injure the affected passenger in the vehicle in the event the bag ruptures. Also the composition of the gas used in air bag systems should also be non-toxic, non-noxious, non-corrosive, containing very minute amounts of CO, $CO_2$, NO and $NO_2$ and less than about 8% $H_2O$, and one which is easily filterable to remove solid or liquid particles thus precluding injury to the vehicle occupants and bag damage.

In air bag systems such as those described above, which utilize an ignitable propellant, the stability and reliability of the propellant composition over the life of the vehicle are also very important. Generally, the propellant composition must possess sufficient stability to temperature, humidity and shock so that it is stable and virtually incapable of being ignited except upon deliberate initiation by activating sensors employed for this purpose.

It follows then that the most desirable atmosphere inside an inflated crash bag would correspond in composition to the air outside it. This has thus far proven impractical to attain. The next best solution is inflation with a physiologically inert or at least innocuous gas. The one gas which possesses the required characteristics and which has proven to be the most practical is nitrogen.

The most successful to date of the prior art solid gas generants of nitrogen that are capable of sustained combustion have been based upon the decomposition of compounds of alkali metal, alkaline earth metal and aluminum derivatives of hydrazoic acid, especially sodium azide.

Typical of such prior art which include sodium azide as one of the reactants compositions capable of generating pure nitrogen for airbag applications are the following U.S. Pat. Nos. 3,741,585; 3,775,199; 3,883,373; 3,895,098; 3,920,575; 3,931 040; 3,996,079; 4,062,708; 4,092,190; 4,203,787; 4,369,079; 4,376,002; 4,533,416; 4,547,235; 4,604,151; 4,734,141; 4,758,287 and 4,836,255.

The disclosures in these documents, particularly as it relates to the wide range of azides possible as well as the complimentary ingredients useable in concert therewith and the various mixture formulations thereof, are incorporated herein by reference.

As indicated in aforementioned U.S. Pat. No. 4,369,079 there are problems and disadvantages, however, in the use of these azides, particularly as it relates to the airbag system's utility. Sodium azide, a Class B poison, is a highly toxic material. It is easily hydrolyzed, forming hydrazoic acid which is not only a highly toxic and explosive gas, but it also readily reacts with metal ions such as Ca, Mg, Pb, Fe, Mn and Cu to form extremely sensitive azide compounds that are subject to unexpected ignition or detonation. Special handling in the manufacture, storage and eventual disposal is therefore required to safely handle such materials.

In the past the powdered ingredients making up the various nitrogen producing gas generant compositions were simply dry mixed or blended together with a conventional dry powder blender/mixer until a homogenous mixture was formed, and the resulting mixture then compacted, molded or pelletized into tablets, pellets or granules by conventional techniques using standard equipment, as indicated in aforementioned U.S. Pat. Nos. 3,741,585; 4,203,787 and 4,547,235. And for safety considerations as with most, if not all, pyrotechnic substances, remote controlled tableting presses are convenient devices which maybe employed for compression to tablets. Wet blending and granulation techniques for mixing the azide and oxidant components prior to being compressed into tablets or pellets in the usual manner have also been suggested, as indicated in aforementioned U.S. Pat. Nos. 3,920,575; 3,996,079; 4,376,002; 4,533,416; 4,734,141 and 4,758,287, especially for safety reasons. Of particular note is the '575, '416 and '287 patents wherein at least two solid gas generant reactants, including an azide, are blended with a liquid dispersant (e.g. $H_2O$) to form a paste or slurry, which is dried and molded into some predetermined shape.

The instant assignee, Morton International, Inc., has earlier developed a completely automated, (remote controlled) continuous wet process and system (as generally depicted in FIG. 1) for making gas generant tablets or pellets wherein known solid ingredients of a generant azide (e.g. sodium azide) and reactants therefor (e.g. molybdenum disulfide and sulfur) are added to and slurried in water, subjected to wet grinding, spray dried to a powder material, and further processed (e.g. compaction molded) to produce pellets or tablets in the usual fashion.

SUMMARY OF THE INVENTION

The overlying primary objective of the present invention is to minimize hazardous (potentially explosive) conditions created by the undesirable formation and build-up of hydrazoic acid and unstable azide compounds produced from such problematic impurity or contaminant metal ion species as Ca, Mg, Pb, Fe, Mn and Cu inherent in assignee's prior referenced gas generant manufacturing facility.

As set forth in greater detail below, this objective has been accomplished by the use of either process A, process B, or the combination of processes A and B, together with the related apparatus. These techniques serve to improve the prior system of making gas generant azide (preferably sodium azide) and an oxidizer/-reactant therefor (preferably $MoS_2$ and S) wherein said ingredients are slurried in water, subjected to wet grinding, dried (e.g. spray) to a powder material which is then further processed (e.g. compaction molded) to produce pellets or tablets.

In accordance with this invention the first improvement to the old system, process A, involves the slurry stage wherein the basicity of the water is adjusted to have a pH within the range of greater than 8.0 to about 12.5 by first adding a base to the water prior to being used to slurry the powdered ingredients, then adding the oxidant/reactant and finally the azide whereby the azide addition is made to a basic mixture of the other ingredients thus prohibiting the formation of hydrazoic acid at hazardous concentration levels.

The basicity of the slurry water is preferably adjusted to a pH range of about 9.0 to about 11.0, and most preferably about 10. Hydrazoic acid is preferably kept below a concentration level of about $3\times10$ EXP $(-3)$, and most preferably below about $3\times10$ EXP$(-5)$ moles per liter.

In accordance with process A the most preferred base is sodium hydroxide, but other bases may be used and are inclusive of the other alkali metal hydroxides, alkaline earth metal hydroxides and even basic salts such as sodium silicate. Least preferred among these bases is the alkaline earths, especially the problematic Mg and Ca hydroxides.

In accordance with this invention the second improvement to the old system, process B, involves minimizing significantly the concentration level of soluble problematic impurity or contaminant metal ions Ca, Mg, Pb, Fe, Mn, and Cu inherent in the slurry mixture by lowering or removing them thus prohibiting the formation of their corresponding unstable and hazardous azide compounds.

In accordance with process B the lowering or removing of the contaminant metal species is: (1) accomplished before slurrying the generant raw materials as by (a) supplying the oxidant/reactant in a purified condition, i.e. stripped of normal impurity metal ions Pb, Fe, Mn and Cu, or by treating said ingredient in situ or on line, e.g. by chemical washing/leaching, to remove such contaminant metal species, and/or (b) supplying the water in a pre-softened condition or softening the water in situ or on line, i.e. stripped of such normally occurring impurity metal ions as Ca and Mg, prior to being used to slurry the mixture, and/or (2) selectively precipitating certain of said species, as non-hazardous compounds in the slurry mix, e.g. by the addition of small quantities of sodium sulfide and/or trisodium phosphate and/or by the addition of sodium hydroxide.

As may be apparent, the concurrent use of process A and B leads to the most preferred practice of the invention because each respective process compliments the other and most effectively removes or prevents the formation of the offending compounds achieving maximum safety.

In accordance with the above inventions the various contaminate metal species discussed are each kept below about 25 ppm, preferably less than about 15 ppm and most preferably less than about 5 ppm.

In accordance with a further aspect of this invention the improvements also extend to various products as produced; namely, the final tablet or pellet, as well as two intermediate products, the first at the slurry stage and the second at the spray dried stage, wherein at each stage the various undesirable metal species have been significantly eliminated or minimized thereby lessening the chances for formation of such unstable and hazardous compounds as hydrazoic acid and metal azides of Ca, Mg, Pb, Fe, Mn and Cu.

It is also noted that the slurry and spray dried intermediates are stable products, fully capable of being separately collected and diverted from the plant, suitably packaged and perhaps sold to another concern to finish the tablet (or some other form or use) where preparation in even a remote geographical location might be appropriate.

DETAILED DESCRIPTION OF THE INVENTION

Figure 1:
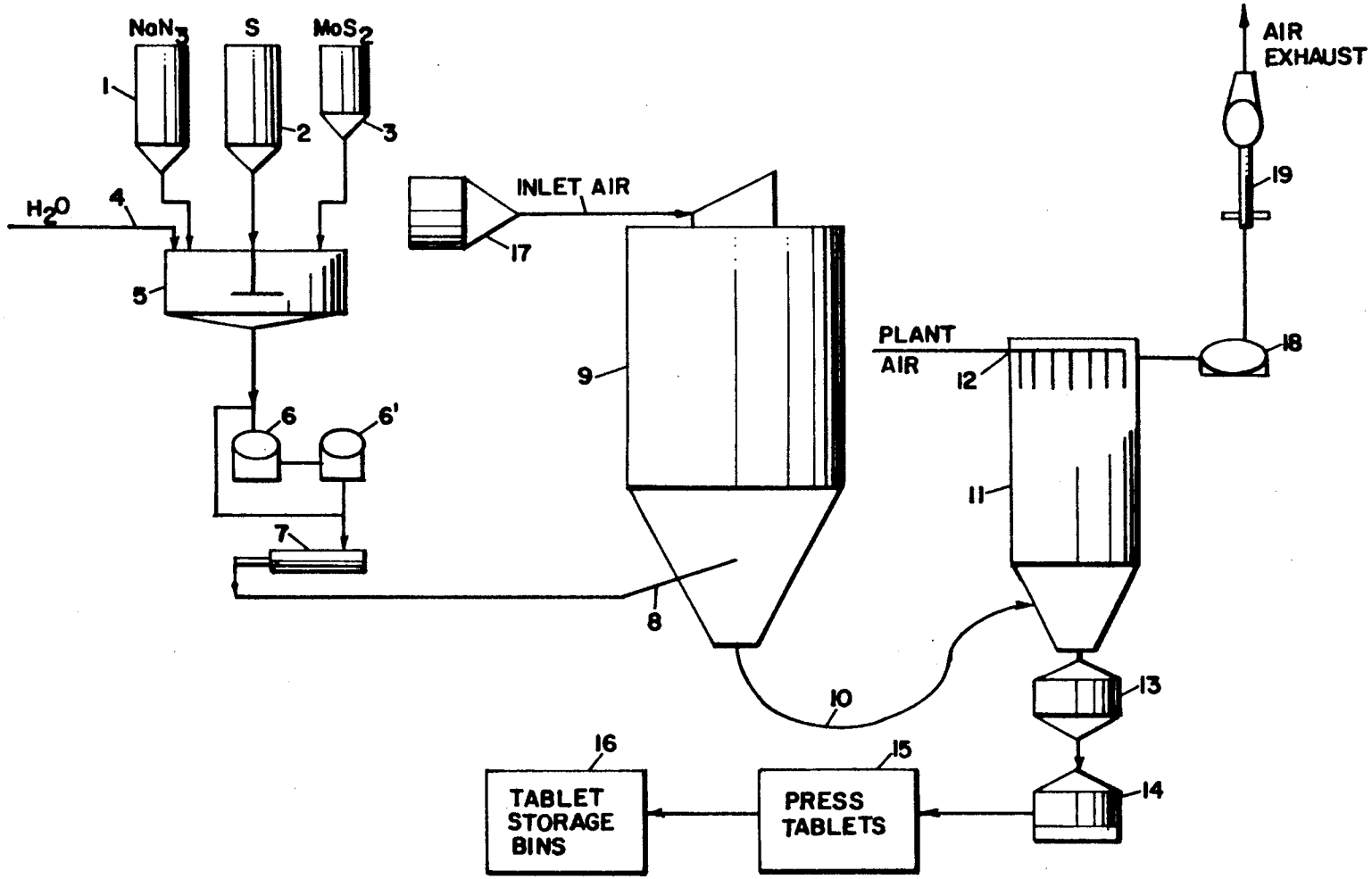
Fig. 1 (PRIOR ART)
FIG. 1 shows assignee's prior gas generant process and plant.
Figure 2:
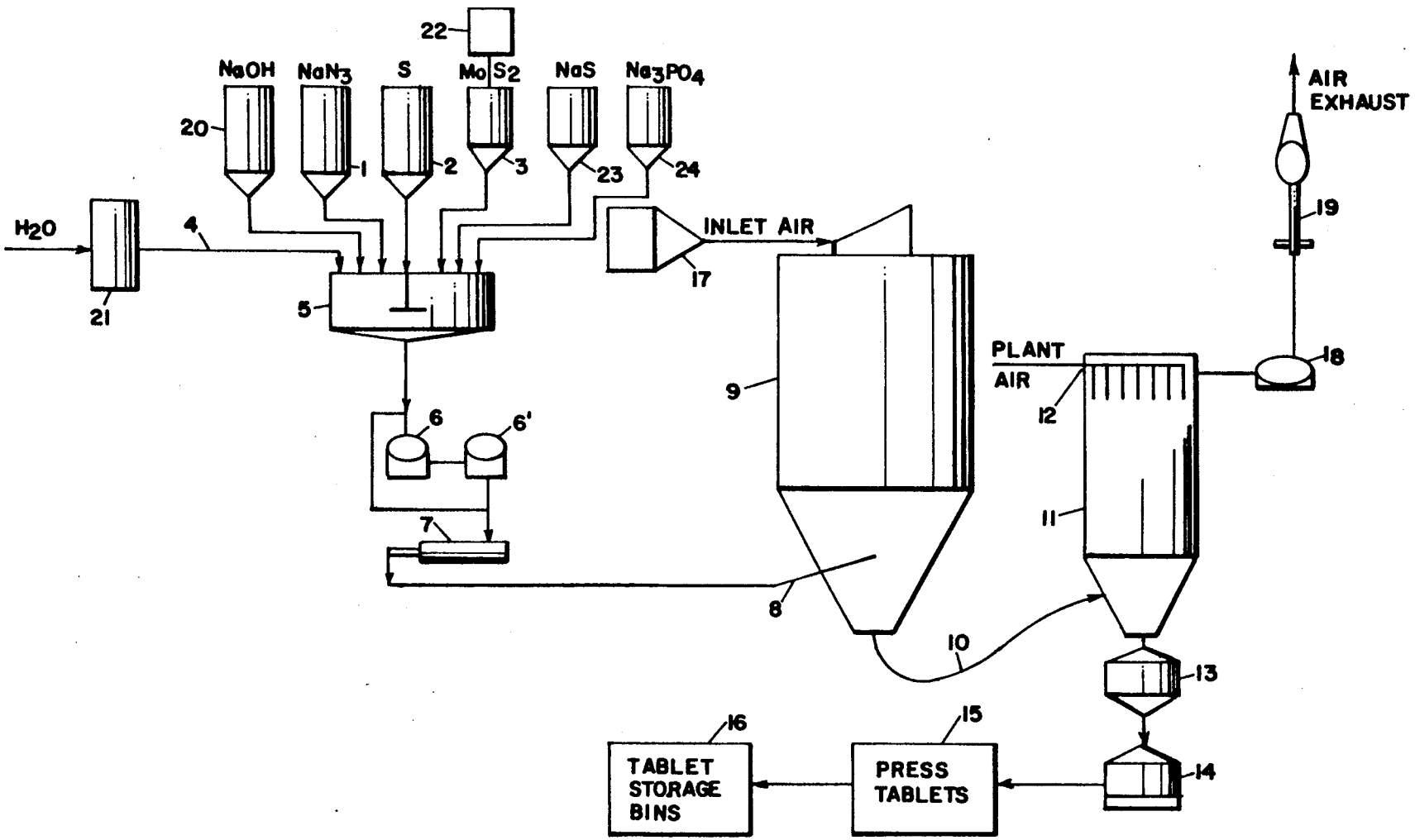
FIG. 2 shows the gas generant process and apparatus or plant according to the invention.

A more complete understanding of the invention will be apparent from the detailed description to follow of the preferred embodiments in conjunction with the prior process and apparatus system depicted in FIG. 1 and the new or improved process and apparatus system depicted in FIG. 2.

In an effort to minimize hazardous conditions that may develop in assignee's prior gas generant manufacturing facility as shown in FIG. 1, an undertaking was made to reduce the manufacturing hazards of the generant by improving the process and apparatus by which it is manufactured. Such prior art generants are made from sodium azide, sulfur and molybdenum disulfide which are provided in weigh-up hoppers 1, 2 and 3, respectively. These materials are slurry mixed in water supplied via line 4 in the slurry tank 5, passed through tandem wet grinding mills 6 and 6', feed pump 7 and then spray dried via nozzle 8 in the drying chamber 9 to a powder material which in turn undergoes further processing, including conveyance through line 10 into baghouse system 11 and 12, collected in hopper 13 and final product bin 14, from where the powdered material is pelleted or tableted at station 15, and stored in bins at station 16. Pellets or tablets are formed at station 15 in a conventional fashion by hydraulically or mechanically pressing into cylindrical shapes small amounts of the powdered material supplied to molds. These pellets or tablets are designed to be subsequently loaded into inflator or airbag systems. Heater-filter 17 is provided whereby dryer 9 may be preheated to near its operating temperature prior to slurry spray drying. Air is drawn through the dryer-baghouse system by exhaust fan 18, which air ultimately exits through water scrubber 19. Exhaust fan 18 also is provided to cool the system to ambient conditions during shut down and cleansing.

It was determined that during the slurrying operation, undesirably high amounts of hydrazoic acid (an extremely explosive gas) were formed by reaction of the azide material with the water, and the potential exists to form undesirable metal azides by exposing the sodium azide to contaminant metals contained within the water supply and raw gas generant ingredients. The water supplied to the system is relatively hard, containing such hardness or contaminant values as calcium and magnesium, in particular. The molybdenum disulfide, being a mined substance has particularly high levels of such metals as lead, iron, copper, and manganese relative to the other formulation ingredients. Any resultant metal azides produced from these impurity or contaminant metal ions are very hazardous compounds in that they are explosive in nature and generally thermally sensitive. They may explode when subjected to friction, impact, ESD (electro static discharge) and when exposed to high thermal gradients. Calcium azide, although not a primary explosive like the corresponding lead and copper compounds, is of primary concern because it is the least thermally stable metal azide compound formable in the process. It decomposes dangerously close to the thermal environment applied to the material during the spray drying process. The sodium azide and the water used to form the slurry mix are the two principal sources of calcium contamination as it is a normal impurity therein. The azide and water reaction proceeds according to the following formula:

$$N_3^- + H(OH) \rightarrow HN_3 + OH^-$$

The formation of undesirable azides of the various metal species are typically represented by the following formulas:

$$(1)\ 2\ N_3^- + Ca^{++} \rightarrow Ca(N_3)_2$$

$$(2)\ 2\ N_3^- + Cu^{++} \rightarrow Cu(N_3)_2$$

To improve process safety, it was determined that such goal could best be obtained by significantly reducing the hydrazoic acid level as well as soluble contaminant metal species in the slurry mix by one or more of the following approaches:

(1) Changing the basicity of the slurry water to have a pH greater than 8 along with changing the order of addition of solid ingredients in the slurry process so as to assure a basic environment and thus preclude adding the sodium azide to an acidic mixture of other ingredients, thus minimizing or prohibiting the formation of hydrazoic acid in high levels during mixing operations; (the goal being to reduce the normal readings by a factor of about 100) and/or (2) Prohibit or minimize significantly the concentration levels of soluble impurity or contaminant metals, e.g. Ca, Mg, Pb, Fe, Mn, and Cu, inherent in the slurry system by (a) lowering or removing these soluble metal species from the generant raw materials, including the water, either before being slurried and/or (b) selectively precipitating these soluble metals as less or non-hazardous compounds in the slurry mix so as to achieve a maximum concentration level of less than about 25 ppm, preferably less than about 15 ppm, and most preferably less than about 5 ppm for each soluble metal specie.

Broadly the objectives of the invention are achieved by using a composition containing a generant azide along with a reactant or oxidizer therefor.

Principally the azide of the present invention is inclusive of alkali metal azides, alkaline earth metal azides, aluminum azides and mixtures thereof.

Such alkaline earth metal azides as calcium azide, barium azide and magnesium azide can be used, and the least preferred among these is the calcium and magnesium azides.

The most preferred azide, however, is the alkali metal azides, among which are lithium, sodium and potassium azide. And the most preferred among these is sodium azide, with potassium azide next most preferred.

The oxidizer/reactant for the azide useful in the practice of the present invention includes: sulfur, metallic sulfides, sulfates, nitrates, nitrites, perchlorates, chlorates, halides and oxides; as well as organic halides; and mixtures thereof, with the metal oxides including those of Fe, Cr, V, Mo, Mn and Cu.

However, the preferred oxidizer/reactant is sulfur combined with a metallic sulfide. Such metallic sulfides as antimony trisulfide, bismuth sulfide, ferrous sulfide, stannous sulfide, tungsten disulfide, aluminum sulfide and molybdenum disulfide can be used, and the most preferred of these is molybdenum disulfide. Least preferred is any water soluble material having any of the problematic Pb, Fe, Mn or Cu cations.

The amount of the generant azide of this invention can range from about 25 to 95 percent by weight based on the total weight of the composition, preferably from about 50 to 85 percent by weight.

The amount of the oxidizer/reactant of this invention can range from about 5 to 75 percent by weight based on the total amount of the composition, preferably from about 20 to 40 percent.

A preferred relatively low temperature nitrogen gas generating composition of this invention contains (in wt. %) (1) from about 50 to 85 percent, preferably about 65 to 75 percent, and most preferred about 68 percent, sodium azide; (2) from about 20 to 40 percent, preferably about 25 to 35 percent, and most preferred about 30 percent, molybdenum disulfide; and (3) from zero to about 10 percent preferably 0.5 to 5 percent, and most preferred about 2 percent, sulfur.

As earlier indicated, a more complete list of azide and reactant/oxidizer materials can be found in aforementioned U.S. Pat. No. 3,741,585. However, as earlier indicated, avoidance of any water soluble material having Pb, Fe, Mn, Cu, Ca and Mg cations is recommended.

The gas generant composition of the present invention can also include various other gas generants, as for example carbonates as in U.S. Pat. No. 3,775,199; and- /or binders, lubricants, water proofing agents and/or burn rate enhancers or boosters, as is common in the art (See aforementioned U.S. Pat. No. 4,734,141), or even amides or tetrazoles as taught in aforementioned U.S. Pat. No. 4,369,079, especially when destined for less severe utilities than vehicle crash bags. Any of these agents similarly introducing such problematic water soluble metal ion species as Ca, Mg, Pb, Fe, Mn and Cu are least preferred and should be avoided.

Though water is the preferred slurrying medium in the practice of the invention, the water may contain other ingredients; for example, misible aliphatic alcohols and/or water glass (sodium silicate in water) as similiarly taught in aforementioned U.S. Pat. Nos. 3,920,575 and 3,996,079.

FIG. 2 of the drawings depicts the new or improved system in accordance with the invention. FIG. 2 is identical to FIG. 1, previously described in detail, except that the various improvement features have been added thereto. Various features which are common to those shown in FIG. 1; namely, reference characters 1–19, have been assigned the same reference numerals, and will not be described further.

As shown in FIG. 2 and under approach (1) above, a source 20 for base addition was added to the prior art system depicted in FIG. 1. The base added in accordance with the invention is inclusive of the hydroxides of sodium, potassium, lithium, rubidium, cesium and mixtures thereof; as well as functional equivalents thereof such as alkaline earth metal hydroxides and even basic salts such as sodium silicate. The alkali metal hydroxides are preferred, with sodium hydroxide being most preferred. By suitable addition of the base the basicity of the slurry mix is adjusted, before addition of the azide thereto, to be basic within the broad pH range of greater than 8 up to about 12.5, preferably in a range of about 9 to about 11, and most preferably at about 10. This pH adjustment lessens hydrazoic acid formation. In addition to this pH adjustment, the order of addition of the raw materials to form the slurry mix is critically important to obtain even further reduction in the undesired hydrazoic acid formation, and that order of addition requires that the sodium azide be added last. The preferred order is as follows: adding (a) the water, then (b) the sodium hydroxide (to obtain desired pH adjustment), (c) the sulfur and (d) the molybdenum disulfide, and (e) the sodium azide last. Though this order is preferred, any order is acceptable for making additions (a) thru (d), as long as the (e) sodium azide addition is last. This order-of-addition technique insures that the azide is added to a basic solution or slurry. And this dual technique, i.e. pH adjustment coupled with a special order-of-addition of ingredients, together make a significant impact on achieving the goal of reducing the hydrazoic acid concentration level. In contrast, in the prior art method (FIG. 1) the azide was added to an acidic slurry of the other ingredients. The addition of the sodium azide then rendered the slurry slightly basic. Consequently the order of addition of the raw materials in accordance with the invention constitutes a change in the aforementioned prior art practice, which change precludes the addition of the azide to an acidic solution which favors the undesirable formation of hydrazoic acid.

Morever, it has also been found that the addition of sodium hydroxide to the slurry mix in accordance with the present invention also has the additional beneficial effect of precipitating certain soluble contaminant metals, e.g. Fe, Mn, Mg, Cu and Pb as the corresponding hydroxides (basic azides) and/or hydroxy azido complexes rather than the normal (more hazardous) azides, e.g. $Pb(N_3)(OH)$. Such azide is formed in preference to the normal azide, $Pb(N_3)_2$. This also occurs with the other impurity metals present except for calcium. The complexes and basic metal azides are much preferable to the normal azides from a safety standpoint because they are less sensitive explosives (to impact, friction, ESD and heat) than are the normal azides.

As above indicated a wide variety of materials can be utilized in the overall process of the invention when considering possible choices of azide and oxidizer/-reactant ingredients, as well as complimentary additives and treating agents. However, as aforementioned and will become even more apparent, whatever materials are chosen, it is definitely most preferred that these materials (whether viewed individually or collectively) not be inclusive of the problematic soluble cations Ca, Mg, Pb, Fe, Mn and Cu due to the danger of forming unstable and potentially explosive azides therefrom. Consequently by such a recommended selection process, the overall aim of this invention to minimize the presence of these ions in the system is furthered, and only impurity amounts of these problematic ions then need to be dealt with.

While approach (1) has been effective in lessening hazardous conditions, other techniques used alone or in combination therewith have also been developed, as set forth in detail below.

Under approach (2) above, the concentration levels of such soluble metal ions Ca and Mg have been successfully lowered or removed through the use of soft water in the process either by supplying the water in a naturally soft condition or a pre-softened condition to the system, or preferably, installing a water softener 21 on line as shown in FIG. 2, thereby softening the water immediately prior to its use in preparing the slurry mix. Typically a standard ion exchange or zeolite-type (reversible) water softener is used. The later technique is preferred because naturally soft or pre-softened water tend to pick-up contaminants or impurities in transient from various sources.

The use of soft water in the process effectively reduces the overall calcium and magnesium levels via two mechanisms; by (a) physically removing the calcium and magnesium from the water and by (b) precipitation of the calcium added with other raw materials by the addition of sodium carbonate from the ion exchange mechanism of the water. The zeolite is effectively a sodium silicate. The sodium is effectively removed from the silicate or ion exchange resin by Mg and Ca ions; this in turn enriches the sodium content of the water. Since the anion of the Ca and Mg is invariably carbonate, the exchanged water is enriched in sodium carbonate. The excess carbonate present in the water causes the precipitation of Ca ions from the slurry. The operational details of the type of water softener chosen are conventional and can be found in any standard chemical engineering handbook.

While the combined use of sodium hydroxide and ingredient order-of-addition under approach (1) and using soft water under approach (2) are quite effective in reducing or removing some of the contaminant metal ions from solution, additional solutions were desired since certain harmful metal ions were found to still remain. As previously mentioned molybdenum disulfide typically provided to the slurry tanks has particularly high levels of such metal impurities as Pb, Fe, Cu and Mn. $MoS_2$ is therefore a chief culprit in the system. The best solution for reducing the contaminant metal content of the slurry is to procure and feed purified raw materials to the slurry, including the $H_2O$. As an alternative to providing purified $MoS_2$ to be loaded into the weigh-up hoppers, a station or system 22 for acid leaching the $MoS_2$ on line maybe installed as shown in FIG. 2. Such technique is capable of up to about 50% removal of the metal impurities. The acid leaching system utilized is a well known procedure wherein the $MoS_2$ and HCl (e.g. 6N) are added to a chemical reactor for a 2–4 hour reaction/digestion time, then washed with water (softened) to achieve a neutral pH of 7.0 and then discharged to a suitable drying means.

Also included in approach (2), as an alternative or in addition to the above described procedure, a technique of precipitating the contaminant metals as known non-hazardous compounds during the slurry process has been devised. This is accomplished by the addition of small quantities of such additives as sodium sulfide and tri-sodium phosphate in the form of the hydrated salts, $Na_2S \cdot 9H_2O$ and $Na_2PO_4 \cdot 12H_2O$, from weigh-in hoppers 23 and 24, respectively, as depicted in FIG. 2, or possibly by solution addition methods. The amount of these additives may range up to 1% by wt. of each, with the most preferred being 0.03 wt. % (sulfide) and 0.05 wt. % (phosphate), respectively. The use of these additives effectively removes these metal ions from solution and raises the thermal stability of the gas generant in each of the three stages of processing; namely, the slurry, spray dried and final product stage.

As previously mentioned sodium azide (along with the water normally used to form the slurry mix) is a principal source of calcium contamination. Slurry mixtures with the Ca content of the sodium azide as high as 200 ppm and as low as 10 ppm have been processed. The main concern is not the total level of Ca but the level of soluble Ca. Softening of the water in the prcess of the invention typically results in Ca levels in the water on the order of less than 0.5 ppm.

By using soft water the Ca level in the water is reduced from about 70 to less than 0.5 ppm and the Mg level is reduced from about 20 to less than 0.5 ppm.

Soluble metal levels in the slurry are given in the Table below at a variety of conditions.

| Metal Condition | Ca | Cu | Fe | Mg | Pb | Mn |
|---|---|---|---|---|---|---|
| 1 | 117 | 0 | 46.2 | 16.5 | 45.5 | 10 |
| 2 | 77.0 | 0 | 0 | 8.0 | 9.6 | 9.0 |
| 3 | 48.5 | 0 | 36.2 | 2.8 | 51.7 | 13.3 |
| 4 | 14.8 | 0 | 0 | 1.0 | 5.4 | 4.0 |
| 5 | 1.4 | 1 | 3.0 | 0.5 | 4.0 | 4.0 |

Condition
1. Slurry made with hard water. pH = 8.0
2. Slurry made with hard water. pH = 10.0
3. Slurry made with soft water. pH = 8.0
4. Slurry made with soft water. pH = 10.0
5. Slurry made with soft water and sodium sulfide and tri-sodium phosphate additives at pH = 10.

Example 1–3 in the above table are either comparative or prior art; whereas examples 4 and 5 depict the invention. The soluble metals are clearly shown to be reduced by the addition of sodium hydroxide, and sodium phosphate and sodium sulfide, and by the use of soft water.

In accordance with the invention the various contaminant metal species are each kept below about 25 ppm, preferably less than about 15 ppm and most preferably less than about 5 ppm.

For solutions of maximum and minimum pH mentioned above the expected range of hydrazoic acid is shown below.

| | |
|---|---|
| pH = 8 | 3.16 × 10 EXP (−3) M |
| pH = 10 | 3.16 × 10 EXP (−5) M |
| pH = 12 | 3.16 × 10 EXP (−7) M |
| pH = 12.5 | 9.99 × 10 EXP (−8) M |

M = Moles/Liter

As indicated above, raising the pH of the slurry has the effect of dramatically reducing the levels of hydrazoic acid in solution. In accordance with the invention the permissable range of hydrazoic acid should be kept below a concentration level of about 3×10EXP(−3) moles per liter.

The method of Accelerating Rate Calorimetry (ARC) was used to measure the thermal stability of the gas generant made according to the invention and monitor the effects of various changes in thermal stability of the generant as changes were made to improve the generant safety aspects. The ARC method provides the minimum temperature (onset temperature) at which a material exhibits exothermic behavior independent of sample size. The ARC data below thus provides the best measure of relative thermal stability of chemical materials made according to the present invention.

| Generant Parameters | ARC onset temp., deg. C. |
|---|---|
| Reg Generant | 130 |
| Reg Generant + NaOH | 150 |
| Reg Generant + awMoS | 166 |
| Reg Generant + add + NaOH | 170 |

aw = acid washed/leached
add = sodium sulfide + tri-sodium triphosphate

The table above shows that the addition of NaOH alone has little affect on the thermal stability of the generant; whereas the use of the additives together with NaOH raises the thermal stability significantly, as well as using acid washed/leached $MoS_2$.

EXAMPLE

The gas generant powder manufacturing operation may be separated into wet and dry processing areas. The gas generant powder is considerably more energetic in the dry state, and hence the dry operation is isolated from the wet generant preparation area. A brief description of both processing areas along with their individual functions follows.

The sodium azide and molybdenum disulfide are vacuum conveyed from their respective raw material bins to designated weigh-up hoppers. The hoppers are mounted on hydraulic load cells whose electrical signals are converted into digital weight readouts monitored from a central control point. Once the correct batch card weights are attained, softened plant water is transferred into a slurry tank underneath the raw material feed hoppers. Agitator blades are then initiated to operate at a relatively slow rpm. Sodium hydroxide addition to the make-up water is completed prior to the addition of gas generant constituents. Sulfur is then added into the slurry tank. The molybdenum disulfide is gravity deposited into the slurry tank, followed by sodium azide addition. The sodium azide is added incrementally into the slurry. Once raw material addition is complete, preprocessing agitation is continued for 60 minutes at a relatively faster rpm to incorporate and blend all ingredients. Sodium hydroxide or base addition is performed 15 minutes prior to processing the blended slurry ingredients.

The next phase of the operation entails feeding the homogeneous slurry through two wet grinding mills for particle size reduction, through a feed pump and to a nozzle located within the temperature stabilized spray dryer. The slurry is atomized and dried within the spray dryer for conveyance through a transfer tube into a product collector. The powder is then gravity deposited into a collection bin. The process is heavily instrumented along the manufacturing path to allow close monitoring and batch repetition of operating conditions. A further detailed description of the spray drying operation follows.

Additional pre-processing steps include heating of the spray dryer to near its operating temperature prior to slurry spray drying. An exhaust fan, downstream from the dryer, is activated and filtered air is pulled through the drying and product collection system. An electrical heater consisting of resistance coils, heats the air prior to entering the spray dryer to a maximum temperature of approximately 400° F. Once a sufficient dryer temperature is reached, water is evaporated through a separate nozzle/orifice entrance into the spray dryer so that the system may be stabilized for slurry processing. The heated air passes through a large diameter transfer tube into the product bag collector, and out through the water scrubber system.

Once system equilibrium is established near the dryer operating temperature, slurry processing is commenced. The slurry is fed from a tank into the first of two wet grinding mills. A partial slurry re-cycle may be provided prior to the mills to ensure more adequate mixing and homogeneity of product. After passing through the first mill, the slurry may be immediately processed through a second mill set at a smaller stator/-rotor gap. A bypass is also provided subsequent to this step to maintain a constant pressure output into a feed pump.

The feed cavity pump provides sufficient pressure to disperse and atomize the mixture within the spray dryer by use of a swirl chamber and orifice. Thus an efficient means is provided to evaporate the associated water from the slurry. By measuring the product output as compared to the dryer input, a total generant loss to the system may be determined. If the system generant loss exceeds a predetermined amount, a cooling fan is provided whereby the system can be cooled to ambient conditions for shutdown and cleansing.

Atomization and drying of the gas generant provides the mechanism to form agglomerates or aggregates of the blended slurry during the product dryer residence time period. The particles are drawn by the air stream into the dryer funnel through a transfer duct. The product is conveyed into the baghouse, a chamber containing numerous cages, each covered by a bag membrane. Air flow is drawn from the chamber by the exhaust fan into a scrubber while the particles adhere to the bags. The bags are periodically pulsed to allow adhered particle flow from the chamber into the final product hopper.

Pellets or tablets are formed by hydraulically or mechanically pressing small amounts of the powder contained in a steel die into a cylindrical geometric shape. Such an operation produces pellets or tablets of consolidated powder materials. These pellets or tablets are subsequently loaded into inflator or airbag systems.

With this description of the invention in detail, those skilled in the art will appreciate that various modifications may be made to the invention without departing from the spirit thereof. Therefore it is not intended that the scope of the invention be limited to the specific embodiments illustrated and described. Rather it is intended that the invention scope be determined by the appended claims and their equivalents.

What is claimed is:

1. In a process of making gas generant pellets or tablets wherein powdered ingredients of a generant azide and an oxidizer and/or reactant therefor are slurried in water, subjected to wet grinding, dried to a powder material which is then further processed to produce the pellets or tablets, the improvement wherein the order of addition of the ingredients in the slurry stage comprises first adding a base to the water to adjust the pH to be within the range of greater than 8.0 up to about 12.5, then adding said oxidant/reactant and finally the azide whereby the azide addition is made to a basic mixture of the other ingredients thus prohibiting the formation of hydrazoic acid at hazardous concentration levels.

2. The process according to claim 1 wherein said pH is adjusted to the range of about 9.0 to about 11.0.

3. The process according to claim 2 wherein the base added to adjust the pH is sodium hydroxide.

4. The process according to claim 2 wherein said pH is adjusted to about 10.0.

5. The process according to claim 4 wherein the base added to adjust the pH is sodium hydroxide.

6. The process according to claim 1 wherein said base is sodium hydroxide.

7. The process according to claim 1 wherein the hydrazoic acid concentration level is kept below about $3\times10EXP(-3)$ moles per liter.

8. The process according to claim 7 wherein the hydrazoic acid concentration level is kept below about $3\times10EXP(-5)$ moles per liter.

9. The process according to claim 1 wherein the generant azide is an alkali metal azide.

10. The process according to claim 9 wherein said alkali metal is sodium.

11. The process according to claim 1 wherein the reactant/ oxidizer includes molybdenum disulfide.

12. The process according to claim 11 wherein the reactant/ oxidizer further includes sulfur.

13. In a process of making gas generant pellets or tablets wherein powdered ingredients of a generant azide and an oxidizer and/or reactant therefor are slurried in water, subjected to wet grinding, dried to a powder material which is then further processed to produce the pellets or tablets, the improvement wherein the concentration level of impurity or contaminant metal ions selected from the group consisting of Ca, Mg, Pb, Fe, Mn, Cu and mixtures thereof inherent in the slurry mixture is minimized significantly by lowering or removing each of them to a range below about 25 ppm thus prohibiting the formation of their corresponding unstable azide compounds in hazardous quantities.

14. The process according to claim 13 wherein the concentration level of each of said metal ions is kept to a range below about 15 ppm.

15. The process according to claim 14 wherein said concentration level is kept to a range below about 5 ppm.

16. The process according to claim 13 wherein the lowering or removing of said impurity metals is accomplished (a) before slurrying the generant raw materials and/or (b) selectively precipitating same as non-hazardous compounds in the slurry mix.

17. The process according to claim 16 wherein the lowering or removing of impurity metals under (a) is accomplished by supplying the oxidizer/reactant in purified condition and/or by treating said ingredient in situ or on line to remove the impurity metals.

18. The process according to claim 17 wherein the oxidizer/ reactant comprises molybdenum disulfide which is treated on line by chemical washing/leaching to remove impurity metals.

19. The process according to claim 16 wherein the impurity metal lowering or removal operation under (a) is performed by supplying the water in a pre-softened condition to the system and/or softening the water in situ or on line prior to being utilized to prepare the slurry mixture.

20. The process according to claim 19 wherein the slurry water supplied is softened in situ or on line.

21. The process according to claim 20 wherein the water is softened by a conventional ion exchange or zeolite-type system.

22. The process according to claim 16 wherein the precipitation operation under (b) is achieved (1) by the addition of small quantities of sodium sulfide, and/or tri-sodium phosphate, and/or (2) by the addition of sodium hydroxide.

23. The process according to claim 22 wherein sodium sulfide and/or tri-sodium phosphate is added in the form of their hydrates and in amounts up to about 1 wt. % of each.

24. The process according to claim 23 wherein said hydrated sulfide and/or phosphate is added in amounts of about 0.030 and about 0.050 wt. %, respectively.

25. The process according to claim 13 wherein the generant azide is an alkali metal azide.

26. The process according to claim 25 wherein said metal is sodium.

27. The process according to claim 13 wherein the reactant/ oxidizer includes molybdenum disulfide.

28. The process according to claim 27 wherein the reactant/oxidizer further includes sulfur.

29. In a process of making gas generant pellets or tablets wherein powdered ingredients of a generant azide and an oxidizer and/or reactant therefor are slurried in water, subjected to wet grinding, dried to a powder material which is then further processed to produce the pellets or tablets, the improvement (a) wherein the order of addition of the ingredients in the slurry stage comprises first adding a base to the water to adjust the pH to be within the range of greater than 8.0 up to about 12.5, then adding said oxidant/reactant and finally the azide so that the azide addition is made to a basic mixture of the other ingredients thus minimizing the formation of hydrazoic acid at hazardous concentration levels and (b) wherein the concentration level of impurity or contaminant metal ions selected from the group consisting of Ca, Mg, Pb, Fe, Mn, Cu and mixtures thereof inherent in the slurry mixture is minimized significantly by lowering or removing each of them to a range below about 25 ppm thus avoiding the formation of the more unstable azide compounds therefrom in hazardous quantities.

30. The process according to claim 29 wherein said pH is adjusted to the range of about 9.0 to about 11.0.

31. The process according to claim 30 wherein the base added to adjust the pH is sodium hydroxide.

32. The process according to claim 30 wherein said pH is adjusted to about 10.0.

33. The process according to claim 32 wherein the base added to adjust the pH is sodium hydroxide.

34. The process according to claim 29 wherein said base is sodium hydroxide.

35. The process according to claim 29 wherein the hydrazoic acid concentration level is kept below about $3\times10EXP(-3)$ moles per liter.

36. The process according to claim 35 wherein the hydrazoic acid concentration level is kept below about $3\times10EXP(-5)$ moles per liter.

37. The process according to claim 29 wherein the generant azide is an alkali metal azide.

38. The process according to claim 37 wherein said alkali metal is sodium.

39. The process according to claim 29 wherein the reactant/ oxidizer includes molybdenum disulfide.

40. The process according to claim 39 wherein the reactant/ oxidizer further includes sulfur.

41. In a process of making gas generant tablets wherein powdered ingredients of sodium azide, sulfur and molybdenum disulfide are slurried in water, subjected to wet grinding, spray dried to a powder material which is then molded into tablets, the improvement wherein sodium hydroxide is first added to the water to adjust the pH to a range of greater than 8 to about 12.5, then the sulfur and molybdenum disulfide are added, and finally the sodium azide whereby the azide addition is made to a basic mixture of the other ingredients thus prohibiting the formation of hydrazoic acid at hazardous concentration levels above about $3\times10EXP(-3)$ moles per liter.

42. In a process of making gas generant tablets wherein powdered ingredients of sodium azide, sulfur and molybdenum disulfide are slurried in water, subjected to wet grinding, spray dried to a powder material which is then molded into tablets, the improvement wherein the concentration level of impurity or contaminant metal ions selected from the group consisting of Ca, Mg, Pb, Fe, Mn, Cu and mixtures thereof inherent in the slurry mixture is minimized significantly by lowering or removing each of them to a range below about 25 ppm by (a) passing the water through a softening system before being used to slurry the ingredients to remove Ca and Mg, and/or (b) by adding sodium sulfide and/or tri-sodium phosphate and/or sodium hydroxide to the slurry to precipitate any remaining Ca, Mg, Pb, Fe, Mn and Cu ions as non-hazardous compounds thus avoiding the formation of the more unstable and dangerous azide compounds formable therefrom in hazardous amounts.

43. In a process of making gas generant tablets wherein powdered ingredients of sodium azide, sulfur and molybdenum disulfide are slurried in water, subjected to wet grinding, spray dried to a powder material which is then molded into tablets, the improvement (a) wherein sodium hydroxide is first added to the water to adjust the pH to a range of greater than 8 to about 12.5, then the sulfur and molybdenum disulfide are added, and finally the sodium azide so that the azide addition is made to a basic mixture of the other ingredients thus minimizing the formation of hydrazoic acid, and keeping said acid below about $3\times10EXP(-3)$ moles per liter, and (b) wherein the concentration level of soluble or contaminant metal ions selected from the group consisting of Ca, Mg, Pb, Fe, Mn, Cu and mixtures thereof inherent in the slurry mixture is minimized significantly by lowering or removing each of them to a range below about 25 ppm by (1) passing the water through a water softening system prior to being used to slurry in order to remove Ca and Mg ions, and/or adding (2) sodium sulfide and/or tri-sodium phosphate and/or sodium hydroxide to the slurry to precipitate any remaining Ca, Mg, Pb, Fe, Mn and Cu ions as non-hazardous compounds, thus avoiding the formation of the more unstable azide compounds formable therefrom in hazardous amounts.

* * * * *